US009347317B2

(12) United States Patent
Wen

(10) Patent No.: US 9,347,317 B2
(45) Date of Patent: May 24, 2016

(54) SHAFT ROTATING DOUBLE-STATOR MULTI-SPEED MOTOR WITH CURVES OF CONSTANT WIDTH

(75) Inventor: Desheng Wen, Qinhuangdao (CN)

(73) Assignee: Yanshan University, Qinhuangdao (CN)

( * ) Notice: Subject to any disclaimer, the term of this patent is extended or adjusted under 35 U.S.C. 154(b) by 0 days.

(21) Appl. No.: 13/381,086

(22) PCT Filed: Mar. 28, 2011

(86) PCT No.: PCT/CN2011/072216
§ 371 (c)(1),
(2), (4) Date: Feb. 28, 2012

(87) PCT Pub. No.: WO2011/120412
PCT Pub. Date: Oct. 6, 2011

(65) Prior Publication Data

US 2013/0039795 A1 Feb. 14, 2013

(30) Foreign Application Priority Data

Mar. 29, 2010 (CN) ..... 2010 1 0137829

(51) Int. Cl.
*F01C 1/344* (2006.01)
*F01C 19/08* (2006.01)
*F01C 21/10* (2006.01)
(Continued)

(52) U.S. Cl.
CPC ..... *F01C 1/3447* (2013.01); *F01C 11/002* (2013.01); *F01C 21/02* (2013.01); *F01C 21/10* (2013.01); *F01C 21/108* (2013.01); *F01C 19/085* (2013.01); *F04C 2240/52* (2013.01); *F04C 2240/801* (2013.01)

(58) Field of Classification Search
CPC .... F01C 11/002; F01C 19/085; F01C 1/3447; F01C 21/02; F01C 21/10; F01C 21/108; F04C 2240/52; F04C 2240/801
USPC ..... 418/22, 209, 4; 310/323
See application file for complete search history.

(56) References Cited

U.S. PATENT DOCUMENTS 3,682,143 A * 8/1972 Leas ..... 123/240
3,761,151 A * 9/1973 Kerr ..... 384/307
(Continued)

FOREIGN PATENT DOCUMENTS

CN 1159528 A 3/2003
CN 1403712 A * 3/2003
(Continued)

OTHER PUBLICATIONS

English Machine Translation of CN 1403712 A, Oct. 2008.*
(Continued)

*Primary Examiner* — Jorge Pereiro
*Assistant Examiner* — Paul Thiede
(74) *Attorney, Agent, or Firm* — Schwabe, Williamson & Wyatt, P.C.

(57) ABSTRACT

Embodiments of double-stator multi-speed motor are described. In embodiments, a motor may include a rotor. The motor may further include an inner stator having a first count of oil distributing ports opened in a surface of the inner stator. The motor may further include an outer stator having a second count of oil distributing ports opened in an inner surface of the outer stator. In some embodiments, the first count is equal to the second count. Other embodiments may be described and/or claimed.

29 Claims, 5 Drawing Sheets

(51) Int. Cl.
*F01C 11/00* (2006.01)
*F01C 21/02* (2006.01)

(56) References Cited

U.S. PATENT DOCUMENTS

| | | | | |
|---|---|---|---|---|
| 4,768,936 | A | 9/1988 | Etemad et al. | |
| 5,328,337 | A * | 7/1994 | Kunta | 417/310 |
| 5,855,474 | A * | 1/1999 | Shouman | 418/6 |
| 7,481,730 | B2 * | 1/2009 | Pesiridis et al. | 475/5 |
| 2004/0007201 | A1 | 1/2004 | Hawaj | |
| 2008/0238254 | A1 * | 10/2008 | Zhou et al. | 310/323.06 |
| 2009/0162225 | A1 * | 6/2009 | Lai et al. | 417/423.3 |
| 2013/0039795 | A1 | 2/2013 | Wen | |

FOREIGN PATENT DOCUMENTS

| | | | |
|---|---|---|---|
| CN | 2760280 | Y | 2/2006 |
| CN | 101144473 | A | 3/2008 |
| CN | 101847917 | A | 9/2010 |
| GB | 2016599 | A | 9/1979 |

OTHER PUBLICATIONS

English Machine Translation of CN 1042861 A, Jun. 13, 1990 (Derwent Abstract).*

"Theoretic Research on Variable Displacement of equal-width Double-Stators Pump and Motor" by De-shong Wen, Shi-jun Lu, Xiao-chen Liu, and Xing-zhou Cai, Journal of Harbin Institute of Technology, vol. 40, No. 11, Nov. 2008.*

English Machine Translation of "Theoretic Research . . . ", Nov. 2008.*

CN Office Action for CN Application No. 201010137829.8, dated Mar. 10, 2011, 7 pagres.

CN Office Action for CN Application No. 2013-501609, dated Dec. 24, 2014, 13 pages.

De-sheng, et al., "Theoretic Research on Variable Displacement of Equal-Width Double-Stators Pump and Motor," Journal of Harb in Institute of Technology, vol. 40, No. 11, Nov. 2008, 5 pages.

* cited by examiner

SHAFT ROTATING DOUBLE-STATOR MULTI-SPEED MOTOR WITH CURVES OF CONSTANT WIDTH

FIELD OF THE INVENTION

The present invention relates to a variable capacity hydraulic machine, and particularly, to a shaft rotating double-stator multi-speed motor with curves of constant width.

DESCRIPTION OF THE RELATED ART

As an increasingly mature hydraulic component, the hydraulic motor is widely applied in different industries. In various motors, most major parts are in a sliding friction state, which not only affects their service lives but also decreases their working efficiencies. In addition, most motors cannot work unless being reset by a return spring, while a fatigue failure of the spring is caused during the reciprocating motion, thus the service life and the reliability of the motor are directly affected. Furthermore, the motors are mainly single input and single output motors, and several motors shall be connected in parallel to achieve multiple speeds. But it is difficult to accommodate several motors in one motor shell simultaneously, so it is hard to realize a large-scale speed change or torque conversion, and also hard to achieve high power, small size or light weight.

The inventor disclosed a double-stator roller pump with curves of constant width (Chinese Patent No. 02144406.4) in 2002, in which a curve of a external surface curve of the inner stator and a curve of a internal surface curve of the outer stator are two similar curves which are smooth and closed. The difference between the curvature radiuses of the outer stator curve and the inner stator curve is a constant. The rotor is a circular ring, which has radial through-grooves for mounting sets of rollers, each set composed of an outer roller body, a link and an inner roller body. The pump has a novel design and works stably, and can serve as either a pump or a motor. However, oil distributing ports of such pump are always provided on a side plate, thus components, such as the sets of rollers, will be worn severely, thereby causing problems such as oil leakage and low efficiency.

SUMMARY OF THE INVENTION

In order to overcome the above deficiency of the prior art, the present invention provides a shaft rotating double-stator multi-speed motor with curves of constant width, which works stably, achieves a high efficiency and can realize a multi-speed output in one motor.

The present invention adopts the following technical solution to solve its technical problem:

A shaft rotating double-stator multi-speed motor with curves of constant width, comprising a rotor, an inner stator mounted in the rotor, an outer stator, sets of sliders mounted on the rotor, a left end cover and a right end cover. An curve of a external surface of a front portion of the inner stator and a curve of an internal surface of the outer stator are two similar curves which are smooth and closed, wherein oil distributing ports in outer stator are opened in the outer stator in the number of 2×n, e.g., two oil distributing ports in outer stator are opened in a single-action motor, four oil distributing ports in outer stator are opened in a double-action motor, and 2×n oil distributing ports in outer stator are opened in a n-action motor (n is the number of actions, which defines as the inlet-outlet circles of a working liquid per rotation of the rotor, n=1 to 10); and oil distributing ports in inner stator are opened on the external surface of the front portion of the inner stator in the same number of the oil distributing ports in outer stator.

Preferably, a positioning key is disposed between the inner stator and the right end cover to prevent a relative rotation therebetween; a left washer is mounted at the bottom of sectorial cylinders of the rotor, and a right washer is mounted at the tail of the sectorial cylinders of the rotor; the rotor is mounted in a cavity of the outer stator by means of a left bearing and a right bearing; the left end cover and the right end cover are mounted on two end faces of the outer stator by fastening bolts.

Preferably, a distance between adjacent edges of two adjacent oil distributing ports in outer stator is larger than or equal to the minimum distance between two tangent lines formed by contacting two adjacent sets of sliders with the internal surface of the outer stator, and the oil distributing ports in outer stator are connected to a hydraulic power unit through oil passing holes in outer stator and a pipeline.

Preferably, a distance between adjacent edges of two adjacent oil distributing ports in inner stator is larger than or equal to the minimum distance between two tangent lines formed by contacting two sets of sliders mounted in the sectorial cylinders of the rotor with the external surface of the front portion of the inner stator, and the oil distributing ports in inner stator are connected to a hydraulic power unit through communicated oil passing holes in inner stator and a pipeline.

An external surface of a rear portion of the inner stator is a cylindrical surface, on which a keyway is machined, a screw thread is machined at the tail of the inner stator, and the inner stator is fixed on the right end cover by a round nut.

A transmission shaft mounting hole is machined at a front end of the rotor, a plurality of uniformly distributed sectorial cylinders for mounting the sets of sliders are machined at a rear portion of the rotor and obtained by machining a circular ring, a distance between two adjacent sectorial cylinders is equal to a width of the set of sliders, and the number of the sectorial cylinders is 4×n (n is the number of actions, n=1 to 10).

An oil leakage hole is machined a center of the rotor center and connected to a leakage oil return port of the rotor.

The left washer is circular, with sectorial holes opened on the circumference for fitting the sectorial cylinders and a central hole opened at the circle center; and the right washer is also circular, with sectorial holes opened on the circumference for fitting the sectorial cylinders, and an inner stator mounting hole opened at the circle center for fitting the cylindrical surface of the inner stator.

The set of sliders may have multiple structures, such as cylinder type, bicylinder type, bicylinder with link type, slider type, or blade type cut from concentric circles. The width of the set of sliders shall meet the width requirement of a groove formed by two adjacent sectorial cylinders of the rotor, and the height of the set of sliders is equal to a required height of the sectorial cylinders of the rotor. The number of the sets of sliders shall be larger than or equal to 4×n (n is the number of actions, n=1 to 10). In the bicylinder with the set of sliders of link type, the radius of the link end shall be larger than the diameter of the cylinder. The set of sliders of slider type shall be obtained by removing portions on both sides of cylinders adopting a distance between the inner and outer curves of the double-stator motor as their diameters.

The present invention has the following beneficial effects: since the oil distributing ports are opened on the internal surface of the elliptical curve of the outer stator and the external surface of the elliptical curve of the front portion of the inner stator, the present invention decreases the wearing of the inner stator, the outer stator and the set of sliders, reduces the leakage, and makes the wearing gap be automatically compensated. In addition, the motor according to the present invention works stably and has a small volume, a light weight, a large specific power, a strong operability, a long service life and a high efficiency. According to the present invention, a plurality of hydraulic motors of different inputs are set in one shell, so as to output different speeds and torques when these motors have different inputs or outputs. The present invention can also serve as a multi-output pump.

DESCRIPTION OF THE REFERENCE NUMBERS

1. Right End Cover
2. Inner Roller
3. Outer Stator
4. Link
5. Rotor
6. Left End Cover
7. Transmission Shaft
8. Oil Leakage Hole
9. Left Bearing
10. Leakage Oil Return port
11. Left Washer
12. Outer Roller
13. Right Washer
14. Adjusting Retaining Ring
15. Fastening Bolt
16. Right Bearing
17. Positioning Key
18. Round Nut
19. Inner Stator
20. Oil Distributing Port in Outer Stator
21. Oil Passing Hole in Outer Stator
22. Set of Sliders
23. Oil Passing Hole in Inner Stator
24. Oil Distributing Port in Inner Stator
25. Transmission Shaft Mounting Hole
26. Sectorial Cylinder
27. Sectorial Hole
28. Inner Stator Mounting Hole
29. Oil Leakage Hole in Washer
30. Fastening Bolt
31. Shaft-Integrated Rotor

DETAILED DESCRIPTION OF THE PREFERRED EMBODIMENTS

As illustrated in FIGS. 1 to 13, the present invention provides a shaft rotating double-stator multi-speed motor with curves of constant width, comprising a rotor, an inner stator mounted in the rotor, an outer stator, sets of sliders mounted on the rotor, a left end cover and a right end cover. A curve of an external surface of a front portion of the inner stator and a curve of an internal surface of the outer stator are two similar curves which are smooth and closed. In the motor, oil distributing ports are opened in the outer stator in the number of 2×n, e.g., two in a single-action motor, four in a double-action motor, and 2×n in a n-action motor (n is the number of the actions, n=1 to 10). Oil distributing ports are opened in the external surface of the front portion of the inner stator in the same number of the oil distributing ports in the outer stator. Since theses oil distributing ports are opened in an internal surface of the outer stator curve and an external surface of the inner stator front portion curve, the present invention decreases the wearing of the inner stator, the outer stator and the set of sliders, reduces the leakage, and enables the wearing gap be automatically compensated.

The embodiments of the present invention are further described in details as follows in conjunction with the drawings and examples.

Example 1

Figure 1:
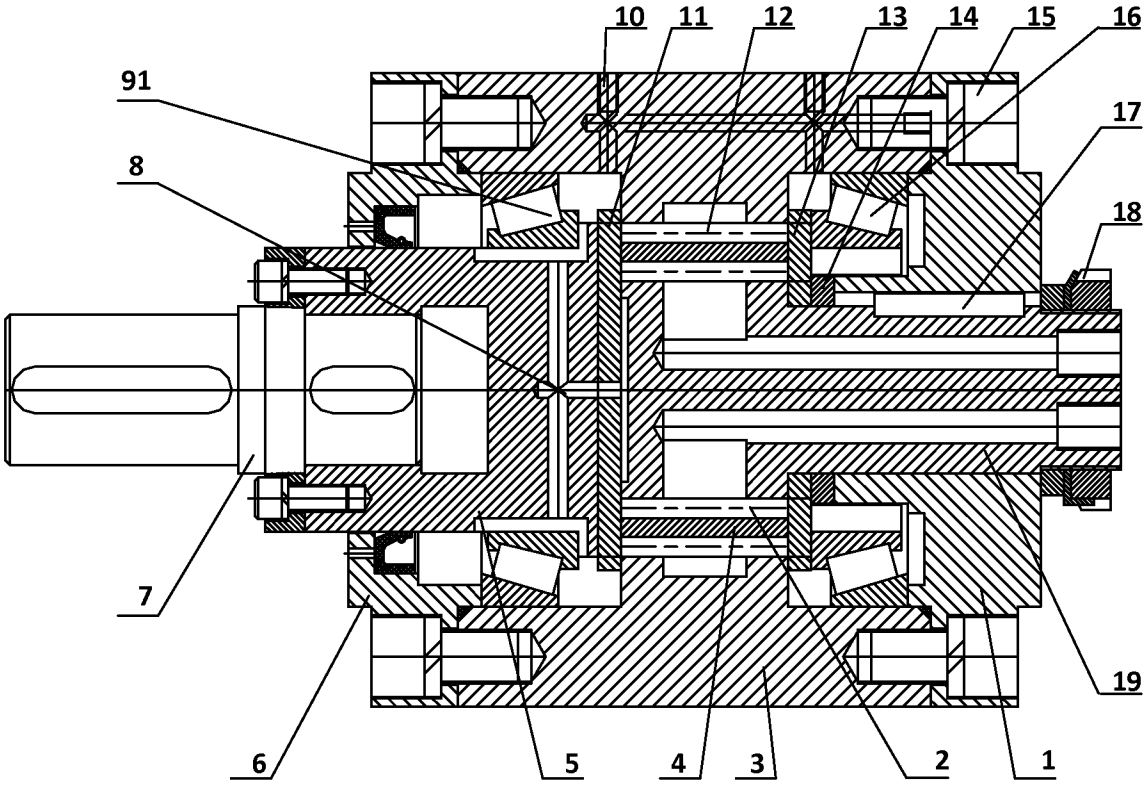
FIG. 1 is a view showing a structure of a shaft rotating double-stator multi-speed motor with curves of constant width.
Figure 2:
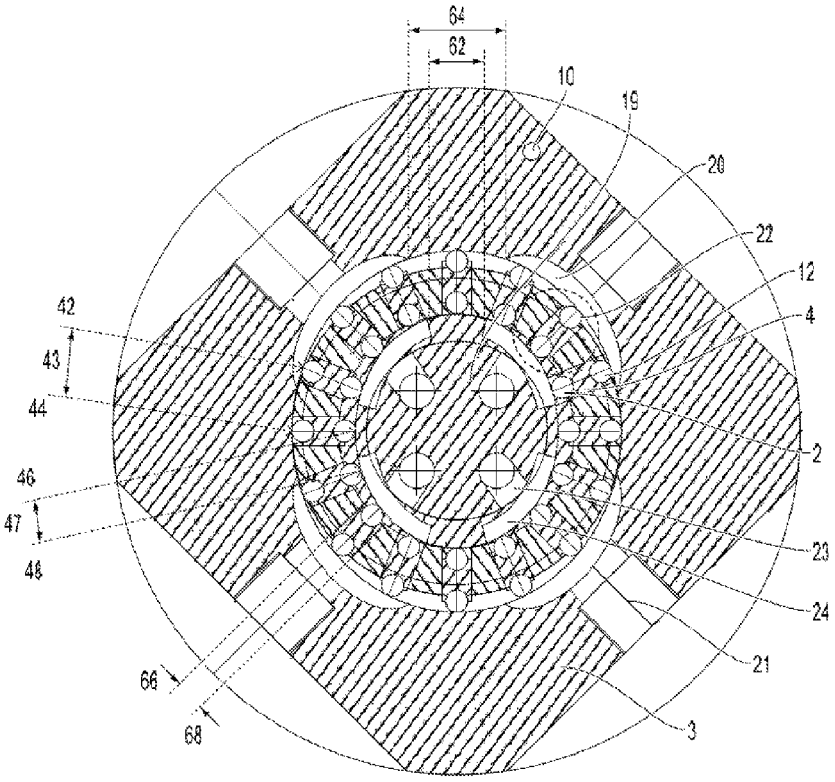
FIG. 2 is a sectional view of the shaft rotating double-stator multi-speed motor with curves of constant width, which mainly illustrates fitting relationships among an outer stator, a rotor, an inner stator and sets of sliders.
Figure 3:
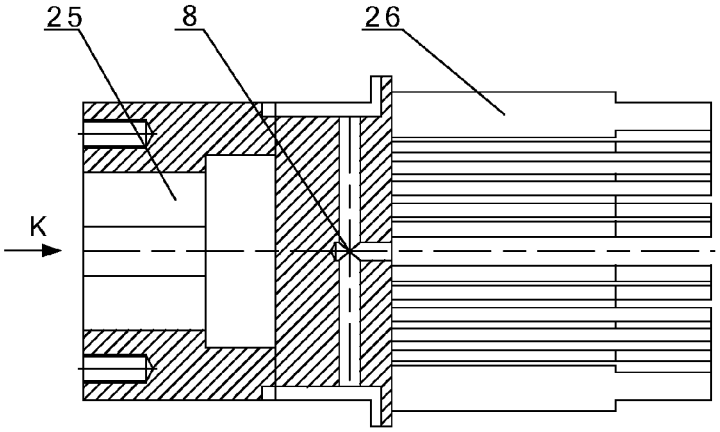
FIG. 3 is a view showing a structure of the rotor.
Figure 4:
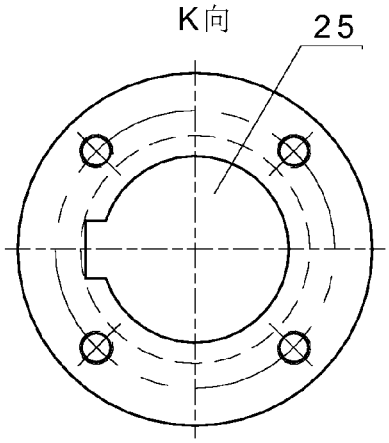
FIG. 4 is a view showing the structure of the rotor in direction K.
Figure 5:
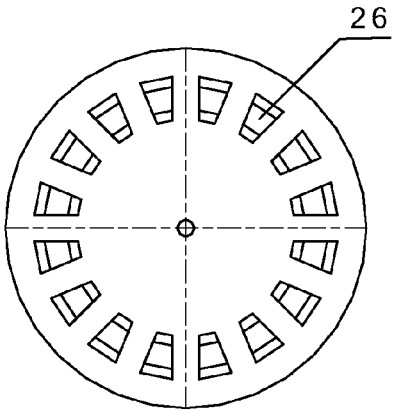
FIG. 5 is a right view of the rotor.
Figure 6:
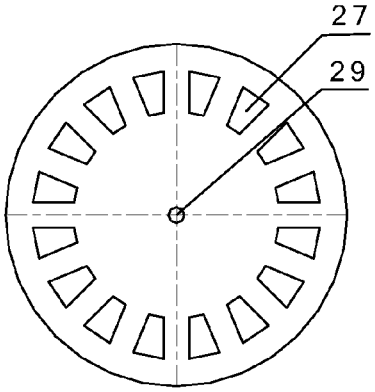
FIG. 6 is view showing a structure of a left washer.
Figure 7:
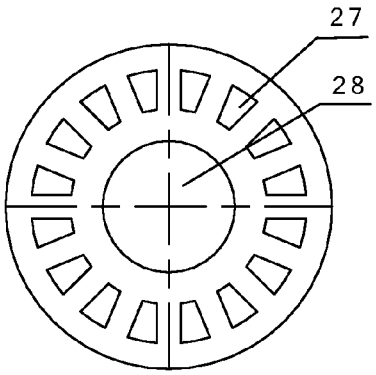
FIG. 7 is view showing a structure of a right washer.
Figure 8:
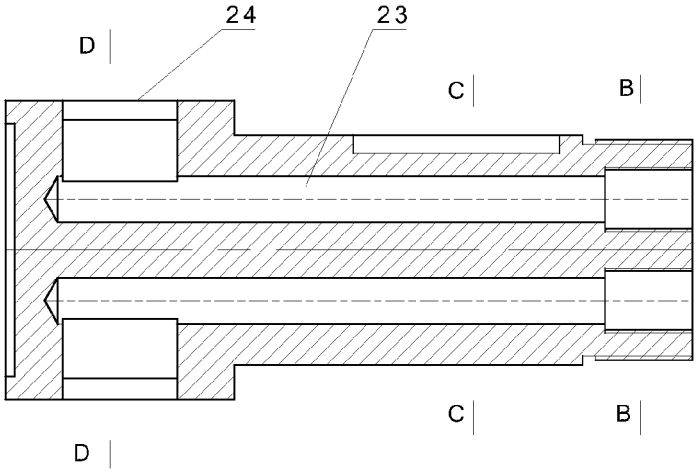
FIG. 8 is view showing a structure of the inner stator.
Figure 9:
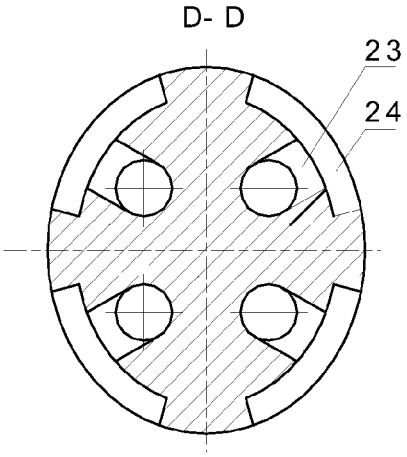
FIG. 9 is a sectional view of the inner stator taken in a line D-D in FIG. 8.
Figure 10:
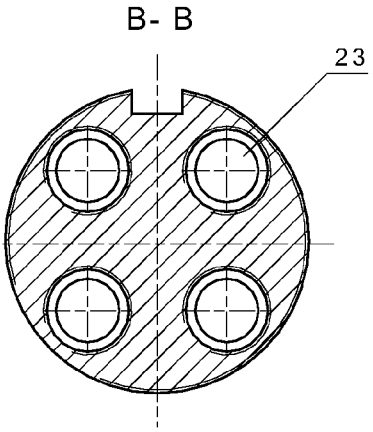
FIG. 10 is a sectional view of the inner stator taken in a line B-B in FIG. 8.
Figure 11:
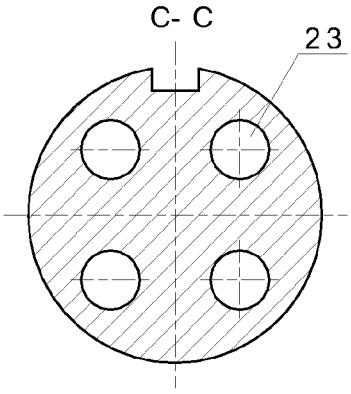
FIG. 11 is a sectional view of the inner stator taken in a line C-C in FIG. 8.

FIG. 1 is an overall view showing a structure of the disclosed shaft rotating double-stator multi-speed motor with curves of constant width according to example 1. The motor comprises a rotor 5, an inner stator 19, an outer stator 3, sets of sliders 22, a left end cover 6 and a right end cover 1. In this example, a curve of an external surface of a front portion of the inner stator 19 and a curve of an internal surface curve of the outer stator 3 are two similar elliptic curves which are smooth and closed. The rotor 5 is mounted with sets of sliders, each set composed of an inner roller 2, a link 4 and an outer roller 12. Four oil distributing ports 20 are opened in the elliptic internal surface of the outer stator 3. Four oil distributing ports 24 are opened in the elliptic external surface of the front portion of the inner stator 19 which is mounted in the rotor 5.

An external surface of a rear portion of the inner stator 19 is a cylindrical surface, on which a keyway is machined to cooperate with a keyway in a shaft hole of the right end cover 1 to prevent a relative rotation therebetween.

A left washer 11, which is a circular member, is mounted on the bottom of the sectorial cylinders 26 of the rotor 5, having sectorial holes 27 on its circumference for fitting sectorial cylinders 26 of the rotor 5, and an oil leakage hole 29 at its center.

A right washer 13 is also a circular member, having sectorial holes 27 on its circumference for fitting the sectorial cylinders of the rotor 5, and an inner stator mounting hole 28 at its center to engage with a cylindrical surface of the inner stator 19. The right washer 13 and an adjusting retaining ring 14 are mounted at the tail of the sectorial cylinders of the rotor 5 to support the rotor.

The two washers may be provided or not provided depending on the actual machining accuracy of the sectorial cylinders. In case the machining accuracy of the sectorial cylinders of the rotor is high, both of the two washers may be omitted.

The rotor 5 is mounted in a cavity of the outer stator 3 by means of a left bearing 91 and a right bearing 16. The left end cover 6 and the right end cover 1 are mounted on two end faces of the outer stator 3 by fastening bolts 15. In this example, the left end cover 6 and the right end cover 1 preferably have a circular periphery, while the outer stator 3 preferably has a slightly square cross section.

The distance 64 between adjacent edges of two adjacent oil distributing ports in outer stator 20 is larger than or equal to the minimum distance 43 between two tangent lines 42 and 44 formed by contacting two adjacent sets of sliders 22 with the internal surface of the outer stator 3, so as to ensure that the adjacent oil distributing ports in outer stator 20 are separated from each other by a set of sliders 22. The oil distributing ports in outer stator 20 are connected to a hydraulic power unit through oil passing holes in outer stator 21 and a pipeline.

The distance 62 between adjacent edges of two adjacent oil distributing ports in inner stator 24 is larger than or equal to the minimum distance 47 between two tangent lines 46 and 48 formed by contacting two adjacent sets of sliders 22 mounted in the sectorial cylinders 26 of the rotor 5 with the external surface of the front portion of the inner stator 19, so as to ensure that the adjacent oil distributing ports in inner stator 24 are separated from each other by a set of sliders 22. The oil distributing ports in inner stator 24 are connected to the hydraulic power unit through oil passing holes in inner stator 23 and a pipeline.

A screw thread is machined at the tail of the inner stator 19 to axially fix the inner stator 19 by being engaged with a round nut 18.

A mounting hole 25 for a transmission shaft 7 is formed at a front end of the rotor 5. The rotor 5 and the transmission shaft 7 are separate parts. The torque and the speed of the rotor 5 are transmitted via the transmission shaft 7. During an operation, a transmission shaft of an actuator or a prime mover may be directly coupled with the rotor mounting hole 25 by a key, thereby omitting the transmission shaft and simplifying the structure of the motor. A rear portion of the rotor 5 is machined with a plurality of uniformly distributed sectorial cylinders 26 for mounting the set of sliders 22. In details, the sectorial cylinders 26 are obtained by machining the cylindrical rear portion of the rotor, and the distance 66 between two sectorial cylinders 26 is equal to the width 68 of each set of sliders. In this example, there are eight sectorial cylinders 26. To be noted, the width of the sectorial cylinders 26 depends on their eccentric distance and determines the flow rate and the rotary speed. During the implementation, the distance between two sectorial cylinders varies in the set of sliders of different type. When the set of sliders 22 belongs to a type of bicylinder with a link, the distance is only equal to the width of the link 4, and the number of sectorial cylinders mounted with the sets of sliders 22 is larger than or equal to 4×n (n is the number of the actions, n=1 to 10). An oil leakage hole 8 is machined at the center of the rotor 5, and connected to a leakage oil return port 10 of the motor.

Example 2

Figure 12:
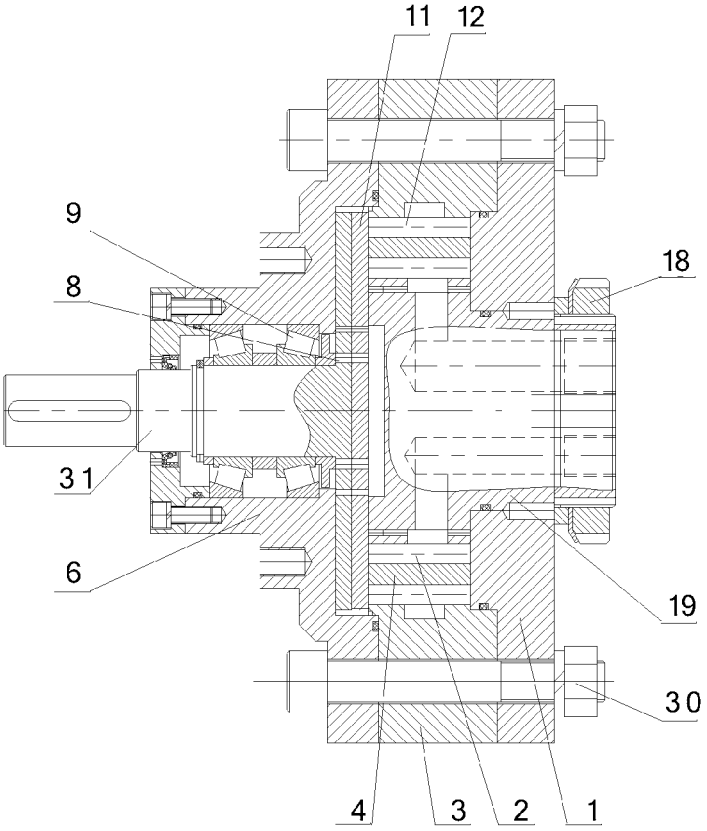
FIG. 12 is a view showing a structure of a half shaft rotating double-stator multi-speed motor with curves of constant width according to another embodiment of the present invention.
Figure 13:
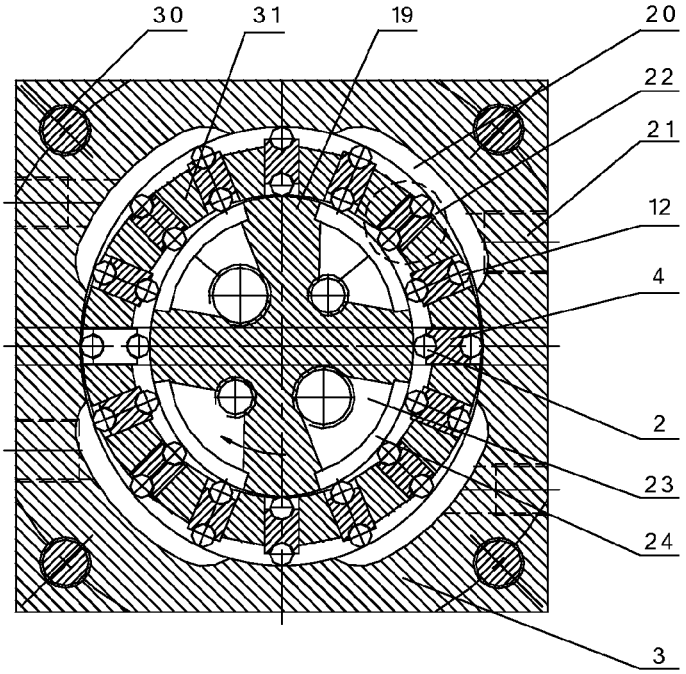
FIG. 13 is a sectional view corresponding to FIG. 12 taken in another direction.

FIG. 12 illustrates a cantilever-type shaft rotating double-stator multi-speed motor with curves of constant width, comprising a rotor 5, an inner stator 19, an outer stator 3, sets of sliders 22, a left end cover 6 and a right end cover 1, wherein an output shaft and the rotor are provided in a form of a shaft-integrated rotor 31, which is mounted in a shaft hole of the left end cover 6 by a centripetal thrust bearing 9, so that the right washer and the right bearing can be omitted. The left end cover 6, the outer stator 3 and the right end cover 1 are fastened by fastening bolts 30. The structures of other portions of the motor are the same as those in Example 1, and herein are not repeated. In addition, for the convenience of understanding the technical solution, the portions of the same function shall be represented with the same reference numeral, but a person skilled in the art may make an appropriate change or selection based on the prior art.

In the above mentioned motors, an inner motor is constructed by the inner stator 19, the inside of a sectorial cylinders 26 of the rotor, the sets of sliders 22 and the end covers at both sides, while an outer motor is constructed by the outer stator 3, the outside of the sectorial cylinders 26 of the rotor, the sets of sliders 22 and the end covers at both sides. As a result, a plenty of inner and outer motors can be formed within one shell, wherein one pair in case of single-action, two pairs in case of double-action, and multiple pairs in case of multi-action. The number of these motors is 2×n, wherein n is the number of the actions, n=1 to 10 but not limited thereto, and preferably n=2 to 5. In this way, a compromise between function request and volume limit of the motor can be well done.

Under the control of a control system, when one of these motors works while other motors are idle, there is a revolution. Different combinations of multiple motors lead to different revolutions, thereby forming a multi-speed motor. A differential motor is formed when the torque corresponding to the inner and outer motors are in opposite directions. One differential motor is formed in case of single-action, and different combinations can be formed in case of double-action and multi-action to form multiple types of differential motors. Therefore, several different speeds can be implemented within one motor shell.

Although the present invention has been disclosed by the examples, it is not limited thereto. Any replacement of equivalent assembly made by a person skilled in the art without deviating from the conception or scope of the present invention, or any equivalent change or modification made according to the patent protection scope of the present invention, shall still be covered by this patent.

What is claimed is:

1. A motor, comprising:

a rotor;

an inner stator, mounted in the rotor, having a first count of oil distributing ports opened in a surface of the inner stator;

an outer stator, connected to the rotor, having a second count of oil distributing ports opened in an inner surface of the outer stator, wherein the first count is equal to the second count; and a plurality of a set of sliders, each set of sliders mounted on the rotor and in contact with the surface of the inner stator and the inner surface of the outer stator, wherein a distance between adjacent edges of two adjacent oil distributing ports in the outer stator is greater than or equal to a distance between two tangent lines formed by contacting two adjacent sets of sliders with the inner surface of the outer stator, or a distance between adjacent edges of two adjacent oil distributing ports in the inner stator is greater than or equal to a distance between two tangent lines formed by contacting two adjacent sets of sliders with the surface of the inner stator.

2. The motor according to claim 1, wherein an oil leakage hole is formed in the rotor and connected to a leakage oil return port.

3. The motor according to claim 1, further comprising:

a first end cover and a second end cover; and a positioning key disposed between the inner stator and the second end cover to prevent relative rotation between the inner stator and the second end cover.

4. The motor according to claim 3, wherein the first end cover and the second end cover are mounted on the outer stator by a plurality of fastening bolts.

5. The motor according to claim 1, wherein an external surface of the inner stator and an internal surface of the outer stator each have an elliptical cross section profile.

6. The motor according to claim 1, wherein the motor is a multi-speed motor based at least in part on the opening of a combination of selected one or more oil distributing ports from the first count of oil distributing ports the opening of and selected one or more oil distributing ports from the second count of oil distributing ports.

7. The motor according to claim 1, wherein the motor is a differential motor when respective torques formed based on the opening of selected one or more oil distributing ports from the first count of oil distributing ports and the opening of selected one or more oil distributing ports from the second count of oil distributing ports are in opposite directions.

8. A motor, comprising:

a rotor;

an inner stator, mounted in the rotor, having a first count of oil distributing ports opened in a surface of the inner stator;

an outer stator, connected to the rotor, having a second count of oil distributing ports opened in an inner surface of the outer stator, wherein the first count is equal to the second count;

a plurality of a set of sliders, each set of sliders mounted on the rotor and in contact with the surface of the inner stator and the inner surface of the outer stator, wherein the length of each set of sliders varies as the rotor turns; and a plurality of uniformly distributed sectorial cylinders, formed on a rear portion of the rotor, for mounting a plurality of sets of sliders, wherein a distance between two adjacent sectorial cylinders of the plurality of uniformly distributed sectorial cylinders is equal to a width of a set of sliders of the plurality of sets of sliders.

9. The motor according to claim 8, wherein an oil leakage hole is formed in the rotor and connected to a leakage oil return port.

10. The motor according to claim 8, further comprising:

a first end cover and a second end cover; and a positioning key disposed between the inner stator and the second end cover to prevent relative rotation between the inner stator and the second end cover.

11. The motor according to claim 10, wherein the first end cover and the second end cover are mounted on the outer stator by a plurality of fastening bolts.

12. The motor according to claim 8, wherein an external surface of the inner stator and an internal surface of the outer stator each have an elliptical cross section profile.

13. The motor according to claim 8, wherein the motor is a multi-speed motor based at least in part on the opening of a combination of selected one or more oil distributing ports from the first count of oil distributing ports the opening of and selected one or more oil distributing ports from the second count of oil distributing ports.

14. The motor according to claim 8, wherein the motor is a differential motor when respective torques formed based on the opening of selected one or more oil distributing ports from the first count of oil distributing ports and the opening of selected one or more oil distributing ports from the second count of oil distributing ports are in opposite directions.

15. A motor, comprising:

a rotor;

an inner stator, mounted in the rotor, having a first count of oil distributing ports opened in a surface of the inner stator;

an outer stator, connected to the rotor, having a second count of oil distributing ports opened in an inner surface of the outer stator, wherein the first count is equal to the second count;

a plurality of a set of sliders, each set of sliders mounted on the rotor and in contact with the surface of the inner stator and the inner surface of the outer stator;

a first washer mounted at a first end of a sectorial cylinder of the rotor; and a second washer mounted at a second end of the sectorial cylinder of the rotor.

16. The motor according to claim 15, wherein the first washer is circular, with a sectorial hole to fit the sectorial cylinder; and the second washer is also circular, with another sectorial hole to fit the sectorial cylinder.

17. The motor according to claim 15, wherein an oil leakage hole is formed in the rotor and connected to a leakage oil return port.

18. The motor according to claim 15, further comprising:

a first end cover and a second end cover; and a positioning key disposed between the inner stator and the second end cover to prevent relative rotation between the inner stator and the second end cover.

19. The motor according to claim 18, wherein the first end cover and the second end cover are mounted on the outer stator by a plurality of fastening bolts.

20. The motor according to claim 15, wherein an external surface of the inner stator and an internal surface of the outer stator each have an elliptical cross section profile.

21. The motor according to claim 15, wherein the motor is a multi-speed motor based at least in part on the opening of a combination of selected one or more oil distributing ports from the first count of oil distributing ports the opening of and selected one or more oil distributing ports from the second count of oil distributing ports.

22. The motor according to claim 15, wherein the motor is a differential motor when respective torques formed based on the opening of selected one or more oil distributing ports from the first count of oil distributing ports and the opening of selected one or more oil distributing ports from the second count of oil distributing ports are in opposite directions.

23. A motor, comprising:

a rotor;

an inner stator, mounted in the rotor, having a first count of oil distributing ports opened in a surface of the inner stator;

an outer stator, connected to the rotor, having a second count of oil distributing ports opened in an inner surface of the outer stator, wherein the first count is equal to the second count; and a plurality of a set of sliders, each set of sliders mounted on the rotor and in contact with the surface of the inner stator and the inner surface of the outer stator;

wherein the rotor is mounted in the outer stator by a plurality of bearings.

24. The motor according to claim 23, wherein an oil leakage hole is formed in the rotor and connected to a leakage oil return port.

25. The motor according to claim 23, further comprising:

a first end cover and a second end cover; and a positioning key disposed between the inner stator and the second end cover to prevent relative rotation between the inner stator and the second end cover.

26. The motor according to claim 25, wherein the first end cover and the second end cover are mounted on the outer stator by a plurality of fastening bolts.

27. The motor according to claim 23, wherein an external surface of the inner stator and an internal surface of the outer stator each have an elliptical cross section profile.

28. The motor according to claim 23, wherein the motor is a multi-speed motor based at least in part on the opening of a combination of selected one or more oil distributing ports from the first count of oil distributing ports the opening of and selected one or more oil distributing ports from the second count of oil distributing ports.

29. The motor according to claim 23, wherein the motor is a differential motor when respective torques formed based on the opening of selected one or more oil distributing ports from the first count of oil distributing ports and the opening of selected one or more oil distributing ports from the second count of oil distributing ports are in opposite directions.

* * * * *